US011562895B2

(12) United States Patent
Guna

(10) Patent No.: US 11,562,895 B2
(45) Date of Patent: Jan. 24, 2023

(54) RF ION TRAP ION LOADING METHOD

(71) Applicant: DH TECHNOLOGIES DEVELOPMENT PTE. LTD., Singapore (SG)

(72) Inventor: Mircea Guna, North York (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 17/274,105

(22) PCT Filed: Sep. 4, 2019

(86) PCT No.: PCT/IB2019/057463
§ 371 (c)(1),
(2) Date: Mar. 5, 2021

(87) PCT Pub. No.: WO2020/049490
PCT Pub. Date: Mar. 12, 2020

(65) Prior Publication Data

US 2021/0202230 A1 Jul. 1, 2021

Related U.S. Application Data

(60) Provisional application No. 62/728,642, filed on Sep. 7, 2018.

(51) Int. Cl.
*H01J 49/42* (2006.01)
*H01J 49/04* (2006.01)

(52) U.S. Cl.
CPC ..... *H01J 49/4225* (2013.01); *H01J 49/0468* (2013.01); *H01J 49/4295* (2013.01)

(58) Field of Classification Search
CPC ..... H01J 49/0468; H01J 49/4225; H01J 49/4295; H01J 49/0031; H01J 49/004; H01J 49/0045
See application file for complete search history.

(56) References Cited

U.S. PATENT DOCUMENTS 6,960,762 B2 11/2005 Kawato et al.
7,034,292 B1 * 4/2006 Whitehouse ..... H01J 49/004 250/281

(Continued)

FOREIGN PATENT DOCUMENTS

WO 2004/086441 A2 10/2004
WO 2009094757 A1 8/2009
WO WO-2009094757 A1 * 8/2009 ..... H01J 49/0481

OTHER PUBLICATIONS

Hager, James, ":New Linear Ion Trap Mass Spectrometer", Rapid Communications in Mass Spectrometry, 2002; 16; 512-526 (Year: 2002).*

(Continued)

*Primary Examiner* — David E Smith

(57) ABSTRACT

A method of processing ions in a mass spectrometer comprises introducing one or more precursor ions into a collision cell to fragment at least a portion of said ions, where the collision cell is configured to confine ions having m/z ratios above a selected threshold (i.e., high m/z ions). The ions are released from the collision cell and introduced into a downstream analyzer ion trap to radially confine high m/z ions. The collision cell and the analyzer ion trap are configured to confine ions having m/z ratios below said selected threshold (i.e., low m/z ions). Ions are introduced into the collision cell and undergo fragmentation. The fragment ions are released from the collision cell and introduced into the analyzer ion trap, thus loading the analyzer ion trap with both high m/z and low m/z ions. The ions are released from the analyzer ion trap and detected by a detector.

20 Claims, 7 Drawing Sheets

(56) References Cited

U.S. PATENT DOCUMENTS

2012/0091334 A1* 4/2012 Guna ..... H01J 49/004
250/283
2013/0009051 A1* 1/2013 Park ..... H01J 49/421
250/282

OTHER PUBLICATIONS

International Search Report and Written Opinion for PCT/IB2017/057463 dated Nov. 26, 2019.
James W. Hager: "A new linear ion trap mass spectrometer", Rapid Communications in Mass Spectrometry., vol. 16, No. 6, Feb. 4, 2002 (Feb. 4, 2002), pp. 512-526, XP055346904, GB, ISSN: 0951-4198.
Gulyuz, Kerim et al: "Hybrid quadrupole mass filter/quadrupole ion trap/time-of-flight-mass spectrometry for infrared multiple photon dissociation spectroscopy of mass-selected ions", Review of Scientific Instruments, AIP, Melville, NY, US, vol. 82, No. 5, May 6, 2011.
James Hager: "Linear Ion Trap Mass Spectrometry with Mass-Selective Axial Ejection" In: "Practical Aspects of Trapped Ion Mass Spectrometry, Volume IV: Theory and Instrumentation", May 25, 2010, CRC Press, XP055642404, ISBN 978-1-4200-8372-9.

* cited by examiner

RF ION TRAP ION LOADING METHOD

RELATED APPLICATION

This application claims priority to U.S. provisional application No. 62/728,642 filed on Sep. 7, 2018, entitled "RF Ion Trap Ion Loading Method," which is incorporated herein by reference in its entirety.

BACKGROUND

The present teachings are generally related to methods and systems for efficient transfer of ions having a wide range of m/z ratios into an ion trap, e.g., a linear ion trap (LIT), in a mass spectrometer.

Mass spectrometry (MS) is an analytical technique for measuring mass-to-charge ratios of molecules, with both qualitative and quantitative applications. MS can be useful for identifying unknown compounds, determining the structure of a particular compound by observing its fragmentation, and quantifying the amount of a particular compound in a sample. Mass spectrometers detect chemical entities as ions such that a conversion of the analytes to charged ions must occur during sample processing.

In tandem mass spectrometry (MS/MS), ions generated from an ion source can be mass selected in a first stage of mass spectrometry (precursor ions), and the precursor ions can be fragmented in a second stage to generate product ions. The product ions can then be detected and analyzed.

In some cases, precursor ions selected by an upstream mass filter can be introduced into an RF ion trap functioning as a collision cell in which they undergo fragmentation. The fragmented ions can then be received by a downstream LIT and released according to their m/z ratios, e.g., via selective mass axial ejection (MSAE), to be detected by a downstream detector.

Conventional linear ion traps can, however, exhibit poor trapping efficiency for large m/z ions at low applied RF voltage(s), due to low effective trapping potential. Increasing the applied RF voltage(s) can increase the trapping efficiency of large m/z ions but could adversely affect the trapping of low m/z ions because at higher applied RF voltage(s) the motion of the low m/z ions can become unstable. As a result, the mass range of linear ion traps is typically parsed using separate sample runs and pieced back together to be able to process ions having a wide range of m/z ratios. Such parsing of the mass range can, however, decrease the duty cycle and sensitivity.

Accordingly, there is a need for improved methods and systems for loading ion traps for use in mass spectrometry.

SUMMARY

In one aspect, a method of processing ions in a mass spectrometer is disclosed, which comprises introducing one or more precursor ions into a collision cell so as to cause fragmentation of at least a portion of said ions into a plurality of ion fragments, where the collision cell can have a plurality of rods to at least one of which an RF voltage can be applied for radially confining at least a portion of the ion fragments. By way of example, the collision cell can include a quadrupole rod set to which RF voltages can be applied for radially confining the ions therein. The RF voltage(s) applied to the collision cell are initially selected so as to radially confine ion fragments having m/z ratios above a threshold (which herein are referred to as high m/z fragments). An analyzer ion trap, e.g., a linear ion trap, is positioned downstream of the collision cell, where the analyzer ion trap includes a plurality of rods to at least one of which an RF voltage can be applied for radially confining ions therein. Similar to the collision cell, initially, the RF voltage(s) applied to the analyzer ion trap are selected to radially confine ion fragments having m/z ratios above said threshold, i.e., high m/z ion fragments.

The ion fragments can then be released from the collision cell into the downstream analyzer ion trap. Substantially concurrent with the introduction of the ions into the analyzer ion trap or with a delay relative to such introduction of the ions into the analyzer ion trap, a gas pressure pulse can be applied to the analyzer ion trap so as to expedite cooling of the ion fragments (and in some cases a plurality of precursor ions) received by the analyzer ion trap. In some embodiments, the application of the gas pressure pulse can raise the internal pressure of the analyzer ion trap by at least a factor of about 1.5, e.g., a factor in a range of about 1.5 to about 10.

Subsequently, the RF voltage(s) applied to the collision cell and the downstream analyzer ion trap can be reduced to a level suitable for radially confining ions having m/z ratios below said threshold (which are herein referred to as low m/z fragments).

This can be followed by the introduction of precursor ions into the collision cell to generate a plurality of fragment ions, and releasing the fragment ions from the collision cell into the downstream analyzer ion trap. In this manner, the analyzer ion trap can be efficiently loaded with high m/z and low m/z ions.

Subsequently, the ions contained in the analyzer ion trap can be released, e.g., via selective mass axial rejection (MSAE), to be received by a downstream detector. The ions can be detected by the downstream detector to generate a mass spectrum.

In some embodiments, the high m/z ions have an m/z ratio greater than about 300, e.g., in a range of about 300 to about 1000, and the low m/z ions have an m/z ratio equal to or less than about 300, e.g., in a range of about 50 to about 300.

In some embodiments, the frequency of the RF voltages applied to any of the collision cell and the analyzer ion trap can be, for example, in a range of about 0.3 MHz to about 2 MHz. In some embodiments, the amplitudes of the RF voltages suitable for radially confining the high m/z ions, e.g., m/z ratios greater than about 300, can be, for example, in a range of about 43.5 $V_{0\text{-}peak}$ at 0.3 MHz to about 1933 $V_{0\text{-}peak}$ at 2 MHz, and the amplitudes of the RF voltages suitable for radially confining the low m/z ions, e.g., m/z ratios in a range of about 50 to about 300, can be, for example, in a range of about 7 to about 322 $V_{0\text{-}peak}$. The above voltages correspond to quadrupole arrays having inscribed $r_0$ radius of 4.17 mm. In some embodiments, the RF voltages applied to the collision cell and the downstream analyzer ion trap for radially confining said high m/z ion fragments are selected to generate a Mathieu parameter (q) greater than about 0.27 for the highest m/z ions in the mass window of interest.

In some embodiments, an axial field can be applied to the collision cell, e.g., via application of a DC voltage to an electrode positioned in the proximity of an exit outlet of the collision cell for axial confinement of ions within the collision cell.

In some embodiments, an ion source, e.g., an atmospheric pressure ionization source, can be employed to generate a plurality of precursor ions. In some such embodiments, a filter, e.g., an RF/DC filter, can be employed to select from the ions generated by the ion source a plurality of precursor ions having m/z ratios in a desired range for introduction into the collision cell.

In a related aspect, a method of processing ions in a mass spectrometer is disclosed, where the mass spectrometer includes a first ion trap and a second analyzer ion trap positioned downstream of said first ion trap, each of said ion traps having a plurality of rods to at least one of which an RF voltage can be applied for radially confining at least a portion of ions within said trap. The method can include applying one or more RF voltage(s) to the first ion trap and the second ion trap so as to radially confine ions having m/z ratios above a threshold ("high m/z ions"). A plurality of ions are introduced into the first ion trap, where in some embodiments, the ions can undergo collisional cooling in the first ion trap. This can be followed by releasing at least a portion of the ions from the first ion trap and introducing those ions into the downstream analyzer ion trap. Substantially concurrent with the introduction of the ions into the analyzer ion trap or with a delay relative to such introduction of ions into the analyzer ion trap, a gas pressure pulse can be applied to the downstream analyzer ion trap to expedite cooling of the ions received by the analyzer ion trap. In some embodiments, the application of the gas pressure pulse to the analyzer ion trap can increase an internal pressure thereof by at least a factor of about 1.5, e.g., a factor in a range of about 1.5 to about 10.

Subsequently, the RF voltage(s) applied to the first ion trap and the downstream analyzer ion trap can be reduced to a level suitable for radially confining ions having m/z ratios below said threshold. In other words, the RF voltage(s) applied to the first ion trap and the downstream analyzer ion trap allow these traps to radially trap high m/z ions while the low m/z ions have a higher probability of being lost, e.g., by striking the rods of the ion traps.

The RF voltages applied to the first ion trap and the downstream analyzer ion trap can then be reduced to a level that would be suitable for radially confining ions having m/z ratios below said threshold, i.e., the low m/z ions. A plurality of ions can then be introduced into the first ion trap, and then released from the first ion trap to be introduced into the downstream analyzer ion trap. Optionally, another gas pressure pulse can be applied to the analyzer ion trap to cause cooling of the ions therein. In this manner, the analyzer ion trap can be loaded with both high m/z and low m/z ions.

Subsequently, the ions can be released from the downstream analyzer ion trap, e.g., via MSAE, to be received by an ion detector, which can detect the ions for generating a mass spectrum.

In a related aspect, a method of introducing ions into a mass analyzer of a mass spectrometer is disclosed, where the mass analyzer includes a plurality of rods, e.g., a set of quadrupole rods, to which one or more RF voltages can be applied for radially confining ions therein. The method can include applying an RF voltage to said at least one rod of the mass analyzer so as to generate an electromagnetic field configured to radially trap ions having m/z ratios above a threshold (i.e., suitable for radially confining high m/z ions), and introducing a plurality of ions into the mass analyzer. A gas pressure pulse can be applied to the mass analyzer to facilitate the cooling of the ions in the mass analyzer. The RF voltage(s) applied to the mass analyzer can then be reduced so as to generate an electromagnetic field that is suitable for radially trapping ions having m/z ratios below said threshold (i.e., suitable for radially confining low m/z ions). A plurality of ions can then be introduced into the mass analyzer. Optionally, another gas pressure pulse can be applied to the mass analyzer to cool the ions contained therein. In this manner, the mass analyzer can be loaded with both high and low m/z ions. The ions can then be released, e.g., via MSAE, from the mass analyzer to be detected by a downstream ion detector.

In a related aspect, a mass spectrometer is disclosed, which comprises a collision cell for receiving a plurality of precursor ions and causing fragmentation thereof to generate a plurality of ion fragments, said collision cell comprising a plurality of rods to at least one of which an RF voltage can be applied to generate an electromagnetic field for radially confining the ion fragments within said collision cell. An analyzer ion trap positioned downstream of the collision cell can receive at least a portion of the ion fragments generated in the collision cell. The mass spectrometer further includes at least one RF voltage source for applying one or more RF voltages to the collision cell and the downstream analyzer ion trap for radially confining ions therein. The mass spectrometer also includes a pulsed gas source that is in fluid communication with said downstream analyzer ion trap for applying a gas pressure pulse to the ion trap to cause cooling of the ions contained therein.

A controller is in communication with the RF voltage source and the pulsed gas source. The controller is configured to perform the following steps for processing the ions: causing the RF voltage source to apply RF voltages to the collision cell and the analyzer ion trap suitable for radially confining high m/z ions therein, causing said pulsed gas source to apply a gas pressure pulse to said downstream analyzer ion trap configured for confining high m/z ions when fragment ions are introduced from the collision cell into said downstream analyzer ion trap to cause cooling of said ions, and subsequently, causing the RF voltage source to reduce said RF voltages applied to said collision cell and said downstream analyzer ion trap to a level suitable for radially confining low m/z ions. The controller is further configured to cause mass selective axial ejection of the ions from the analyzer ion trap, e.g., by effecting an AC voltage source to apply appropriate voltages to the rods of the analyzer, following the performance of the above steps.

The mass spectrometer can further include an ion source for generating ions. A variety of different ion sources can be employed. By way of example, the ion source can be an atmospheric ionization source, an atmospheric pressure photoionization (APPI), an electrospray ionization (ESI), a thermospray ionization, among others.

In some embodiments, a mass filter, e.g., an RF/DC mass filter, can be disposed between the ion source and the collision cell. By way of example, the mass filter can be configured to select precursor ions having m/z ratios within a desired range for introduction into the collision cell.

The collision cell and the analyzer ion trap can be configured in a variety of different ways. By way of example, in some embodiments, the collision cell and the analyzer ion trap can include a set of quadrupole rod sets to which RF voltages can be applied for radially confining ions. In other embodiments, any of the collision cell and the analyzer ion trap can include other multi-pole configurations, such as hexapole. In some embodiments, the collision cell and the downstream analyzer ion trap can be capacitively coupled to one another.

In some embodiments, the ion fragments generated in the collision cell can have m/z ratios in a range of about 50 to about 2000, e.g., in a range of about 50 to about 1000.

In some embodiments of the above mass spectrometer, the collision cell is configured to cause primarily cooling of ions rather than their fragmentation. Further, in some embodiments, the spectrometer may lack a collision cell and the analyzer ion trap can receive ions directly, or via one or more ion guides, from an ion source.

Further understanding of the present teachings can be obtained by reference to the following detailed description in conjunction with the associated drawings, which are described briefly below.

DETAILED DESCRIPTION

The present teachings are generally related to methods and systems for processing ions in a mass spectrometer. In some embodiments, the methods include loading one or more ion traps with ions having a wide range of m/z ratios, e.g., m/z ratios in a range of about 50 to about 1000, in two or more stages, where in one stage the one or more ion traps are configured to confine ions having high m/z ratios, e.g., m/z ratios greater than about 300, and in at least another stage the one or more ion traps are configured to confine ions having low m/z ratios, e.g., m/z ratios in a range of about 50 and 300. As discussed in more detail below, the present teachings provide certain advantages relative to conventional methods for loading ions into an ion trap, e.g., for both enhanced product ion (EPI) scans and enhanced mass spectrometry (EMS), such as efficient loading of ion traps and an increase in the duty cycle of mass analysis.

In EPI, precursor ions, e.g., precursor ions selected by an upstream filter, can be fragmented in a collision cell and the fragment ions together with any remaining precursor ions can be trapped in a downstream ion trap, where the ions can undergo collisional cooling. Subsequently, the ions can be released from the ion trap, e.g., via mass selective axial ejection (MSAE) to be detected by a downstream detector. Typically, ion traps have a low mass cut-off, which usually corresponds to about one-third of the mass of the precursor ions. For example, if the RF voltage applied to the ion trap is selected to correspond to Mathieu parameter (q) of 0.3 for precursor ions, the low mass cut-off (q of about 0.906) will occur for an m/z ratio of 0.33×m/z (precursor). Alternatively, if the RF voltage applied to the ion trap is set so as to trap low m/z ions, the trapping efficiency for large m/z ions could potentially become poor. Thus, in conventional systems, different mass segments need to be used to obtain a complete spectrum, e.g., a complete collision-induced dissociation (CID) spectrum, e.g., down to an m/z ratio of 50 or 30. The number of segments that may be required for obtaining a complete spectrum can depend, e.g., on the mass range and the mass of the precursor ion. A significant drawback of such conventional methods is that each mass segment requires a full cycle (injection, trapping, cooling and mass analysis), which can significantly increase the duty cycle of both EPI and EMS scans. In contrast, the present teachings can provide methods and systems for generating full spectra, e.g., EPI or EMS spectra, without mass parsing.

Figure 1:
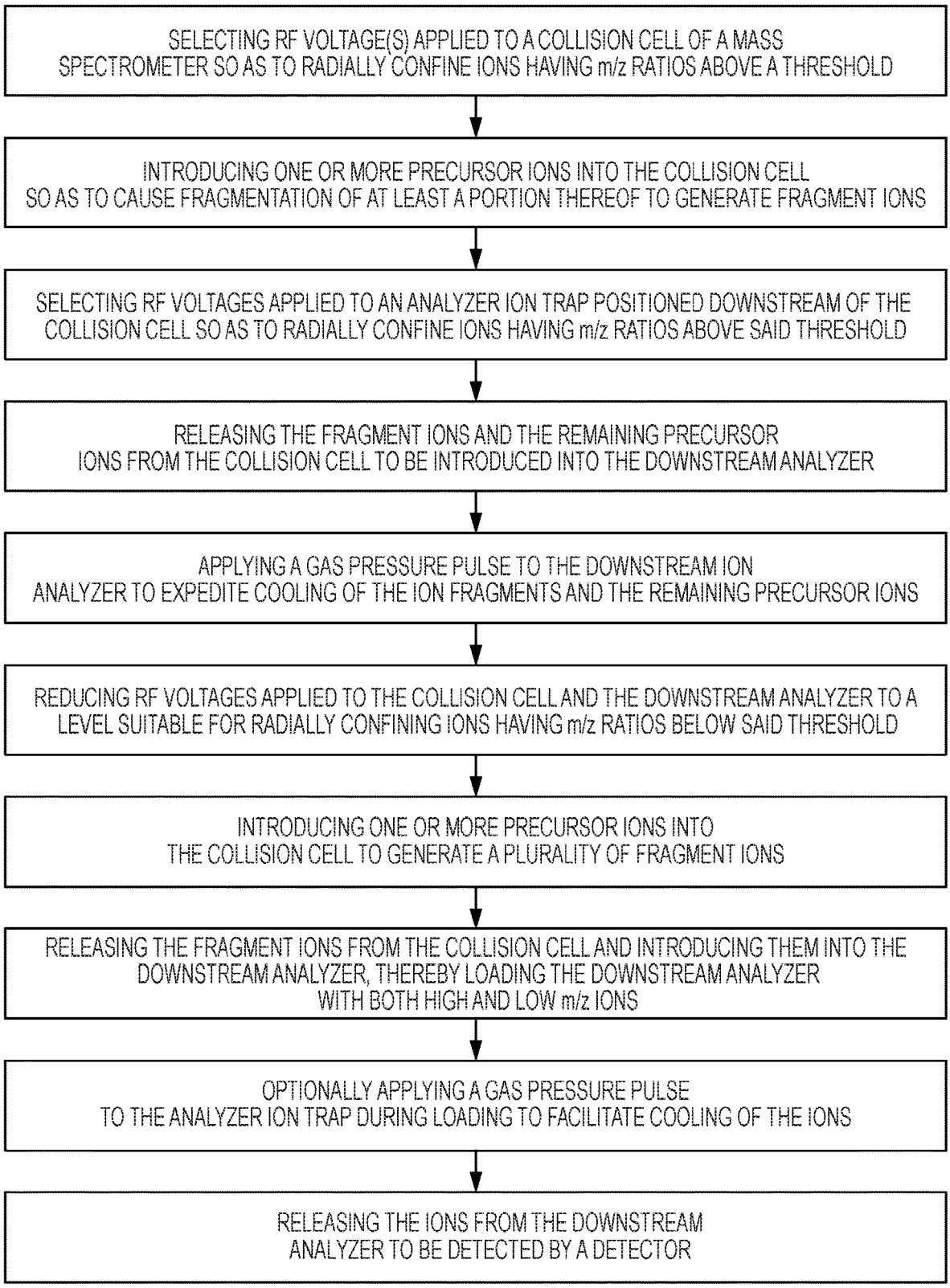
FIG. 1 is a flow chart depicting various steps in a method according to an embodiment of the present teachings for processing ions in a mass spectrometer.

With reference to flow chart of FIG. 1, in a method according to an embodiment for processing ions in a mass spectrometer, one or more precursor ions are introduced into a collision cell so as to cause fragmentation of at least a portion of the ions into a plurality of ion fragments. In this embodiment, the collision cell includes a quadrupole rod set to at least one of which an RF voltage can be applied for radially confining at least a portion of the ion fragments. Initially, the RF voltage applied to the collision cell is selected so as to radially confine ion fragments having m/z ratios above a threshold (which herein are referred to as "high m/z fragments"). The ion fragments are then released from the collision cell to a downstream analyzer ion trap. In this embodiment, the analyzer ion trap includes a quadrupole rod set to at least one of which an RF voltage can be applied for radially confining the ion fragments. Prior to or concurrent with the introduction of the ion fragments into the analyzer ion trap, the RF voltage(s) applied to the ion trap can be selected so as to radially confine the high m/z fragments. In many embodiments, the collision cell and the downstream analyzer ion trap are capacitively coupled.

In some embodiments, due to the high pressure of the collision cell, e.g., a pressure in a range of about 1 to about 15 mTorr, ions received by the collision cell are cooled rapidly and no additional cooling time may be needed after the fill period.

In some embodiments, the ion fragments can have m/z ratios in a range of about 50 to about 1000. In some such cases, the high m/z fragments can have m/z ratios greater than about 300, and the low m/z fragments can have m/z ratios equal to or less than about 300, e.g., in a range of about 50 to about 300.

A gas pressure pulse is applied to the analyzer ion trap to expedite cooling of the ion fragments. In some embodiments, the gas pressure pulse can be applied to the analyzer ion trap concurrently with the introduction of the ion fragments into the analyzer ion trap. In other embodiments, the gas pressure pulse can be delayed relative to the introduction of the ions released from the collision cell into the mass analyzer. In other embodiments, the gas pressure pulse can start before the introduction of the ions released from the collision cell into the mass analyzer and can last during the time of ion introduction and beyond ion introduction. In some embodiments, the duration of the gas pulse can be, for example, in a range of about 0.1 ms to about 20 ms, e.g., in a range of about 0.1 ms to about 5 ms. In some embodiments, the duration of the pressure pulse can be between about 0.1 ms to about 20 ms.

In some embodiments, the application of the gas pressure pulse to the analyzer ion trap can increase an internal pressure of the analyzer ion trap by a factor, in a range of about 1.5 to about 10, e.g., about 300%. For example, the application of the gas pressure pulse can increase the internal pressure of the analyzer ion trap from about $2\times10^{-5}$ Torr to about $8\times10^{-5}$ Torr. Such increase in the internal pressure of the analyzer ion trap can reduce the energy of the ions entering the mass analyzer, thus increasing the trapping efficiency as well as expedite collisional cooling of the ions contained therein.

Subsequent to the introduction of the ions into the mass analyzer and the application of the gas pressure pulse, the RF voltage(s) applied to the collision cell and the downstream analyzer ion trap can be reduced to a level that would be suitable for radially confining ion fragments having m/z ratios below the aforementioned threshold (which herein are referred to as "low m/z ions"). This is then followed by the introduction of a plurality of precursor ions into the collision cell to generate a plurality of ion fragments.

The ions contained in the collision cell are released from the collision cell and are introduced into the analyzer ion trap. In some embodiments, another gas pressure pulse can be optionally applied to the analyzer ion trap to facilitate cooling of the ions, and particularly, the cooling of the newly-arrived low m/z ions. The cooling of the ions allow efficient trapping of not only the low m/z but also the high m/z ions despite the low RF effective potential (e.g., D=qV/8, where q is the Mathieu parameter, and $V_{peak\text{-}to\text{-}peak}$ is the amplitude of the RF voltage). The ions can then be released from the analyzer ion trap using, e.g., mass selective axial ejection (MSAE), to be detected by a downstream detector.

The increased pressure in the analyzer ion trap due to the application of the gas pressure pulse can significantly reduce the total fill plus cool time of the analyzer ion trap, e.g., about 5 millisecond (msec) or less, which can in turn enhance the duty cycle of mass analysis.

The ions can be generated by an ion source, such as an atmospheric pressure ionization source. In some embodiments, a filter can be positioned between the ion source and the collision cell to select ions having m/z ratios in a particular range. By way of example, such a filter can include a quadrupole rod set to which RF/DC voltages can be applied to allow selecting ions having m/z ratios in a particular range for passage through the filter. In some embodiments, the RF voltages applied to the collision cell and the downstream analyzer ion trap for radially confining said high m/z ion fragments are selected to generate a Mathieu parameter (q) greater than about 0.27.

Figure 2:
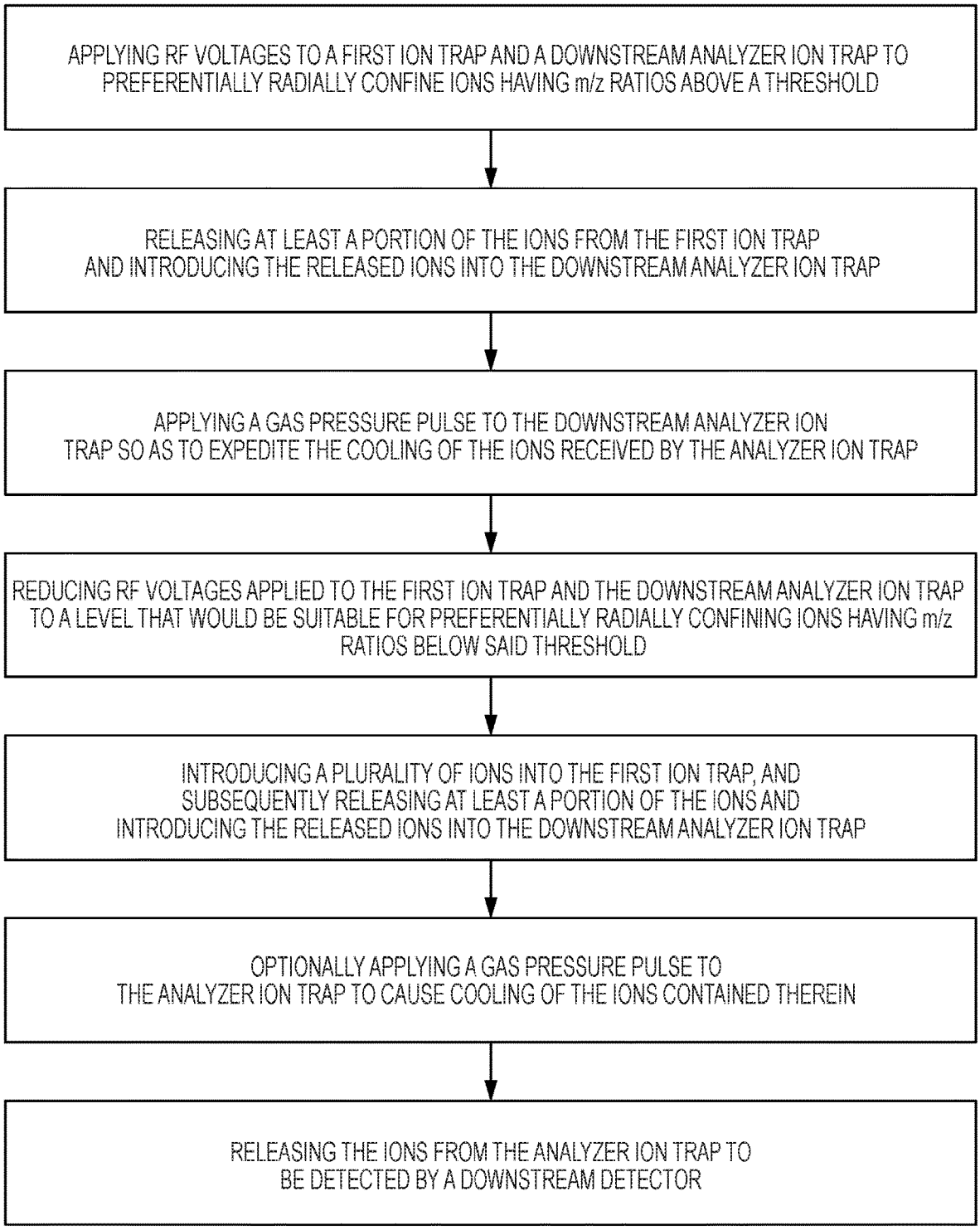
FIG. 2 is a flow chart depicting various steps of a related method according to an embodiment of the present teachings for processing ions in a mass spectrometer.

The present teachings can be employed to obtain not only EPI spectra but also EMS spectra. For example, with reference to the flow chart of FIG. 2, in another embodiment, a method of processing ions in a mass spectrometer includes applying RF voltages to a first ion trap and a downstream analyzer ion trap so as to radially confine ions having m/z ratios above a threshold (which are herein referred to as "high m/z ions").

By way of example, the high m/z ions can have m/z ratios greater than about 300, e.g., in a range of about 300 to about 1000.

A plurality of ions are then introduced into the first ion trap, e.g., a collision cell. In this embodiment, the kinetic energy of the ions introduced into the collision cell are selected so as to minimize fragmentation of the ions during their passage through the collision cell, e.g., ion energies less than about 10 eV.

The fill time for trapping ions in the collision cell can be, for example, in a range of about 2 to about 200 msec. At least a portion of the ions in the first ion trap are released and introduced into the downstream analyzer ion trap.

A gas pressure pulse is applied to the downstream analyzer ion trap so as to expedite the cooling of the ions received from the collision cell by the analyzer ion trap. In some embodiments, the gas pressure pulse can be applied to the analyzer ion trap substantially concurrently with the introduction of the ions from the first ion trap into the analyzer ion trap. In other embodiments, the gas pressure pulse can be delayed relative to the introduction of the ions from the first ion trap into the analyzer ion trap. In other embodiments, the gas pressure pulse can start before the introduction of the ions from the first ion trap into the analyzer ion trap. By way of example, in some embodiments the gas pulse can start 1 ms before the ion introduction from the first ion trap into the second ion trap. The increase in the internal pressure of the analyzer ion trap can expedite cooling of the ions received thereby, e.g., typically in about 40 to 60 msec.

Subsequently, the RF voltages applied to the first ion trap and the downstream analyzer ion trap are reduced to a level that would be suitable for radially confining ions having m/z ratios below said threshold (which herein are referred to as low m/z ions). This can be followed by introducing a plurality of ions into the first ion trap. At least a portion of the ions can be released from the first ion trap, e.g., after a desired time period after introduction of the ions into the first ion trap, and the released ions can be introduced into the downstream analyzer ion trap.

Following the introduction of the low m/z ions into the analyzer ion trap, the analyzer ion trap contains both high m/z and low m/z ions. The ions contained in the analyzer ion trap can then be released, e.g., via MSAE, to be detected by a downstream ion detector.

In some embodiments, the present teachings can be applied to an analyzer ion trap that can receive ions from an ion source without the ions first being introduced into an upstream collision cell. Similar to the previous embodiments, the RF voltages applied to the analyzer ion trap can be modulated so as to efficiently trap both high m/z and low m/z ions in the analyzer ion trap prior to releasing those ions from the analyzer ion trap to be detected by a downstream ion detector.

Figure 3:
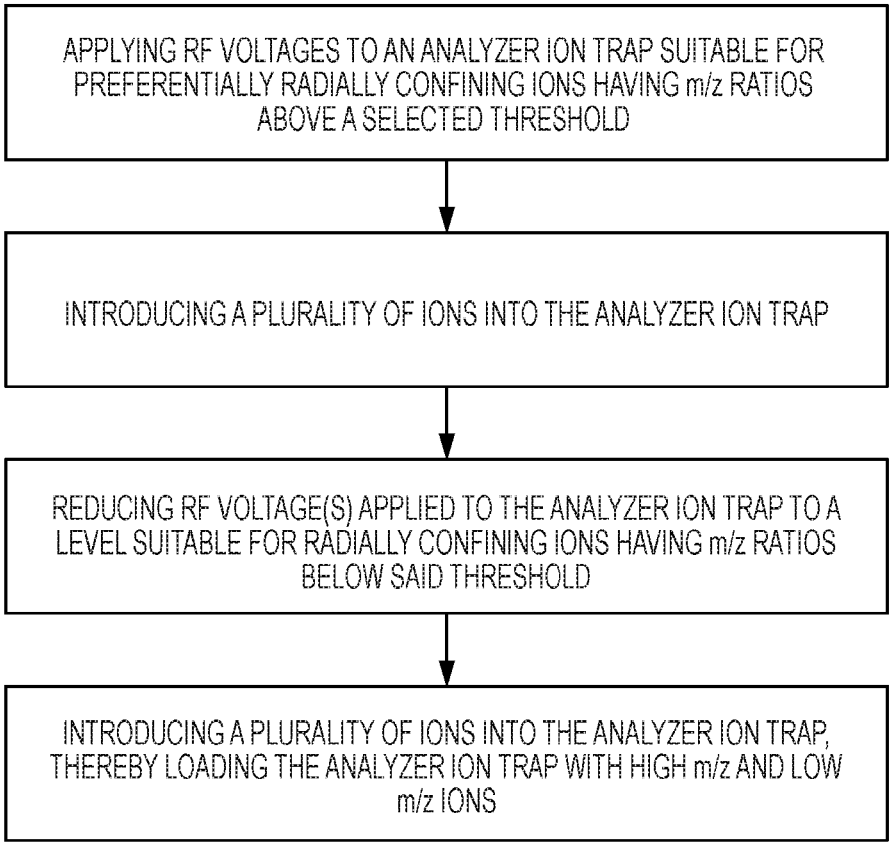
FIG. 3 is a flow chart depicting various steps in a method according to an embodiment for processing ions in a mass spectrometer, and FIG. 4A schematically depicts a mass spectrometer according to an embodiment of the present teachings, FIG. 4B schematically depicts a gas source, comprising a gas reservoir and a valve, which is employed in the mass spectrometer of FIG. 4A for applying a gas pressure pulse to an ion analyzer.

More specifically, with reference to the flow chart of FIG. 3, in such an embodiment, the RF voltage(s) applied to an analyzer ion trap can be selected such that the analyzer ion trap would radially confine ions having m/z ratios above a selected threshold (i.e., high m/z ions). A plurality of ions can then be introduced from an ion source into the analyzer ion trap. In some embodiments, one or more mass filters (e.g., RF/DC mass filters) can be disposed between the ion source and the analyzer ion trap to help select ions having m/z ratios within a desired range. A gas pressure pulse can be applied to the analyzer ion trap to expedite cooling of the ion fragments. Subsequently, the RF voltage(s) applied to the analyzer ion trap can be reduced to a level that would be suitable for radially confining ions having m/z ratios below said selected threshold (i.e., low m/z ions). This is followed by introducing ions from the ion source into the ion trap. In this manner, both low m/z and high m/z ions can be trapped in the analyzer ion trap.

Subsequently, the ions contained in the analyzer ion trap can be released, e.g., via MSAE, to be detected by a downstream detector.

Figure 4A:
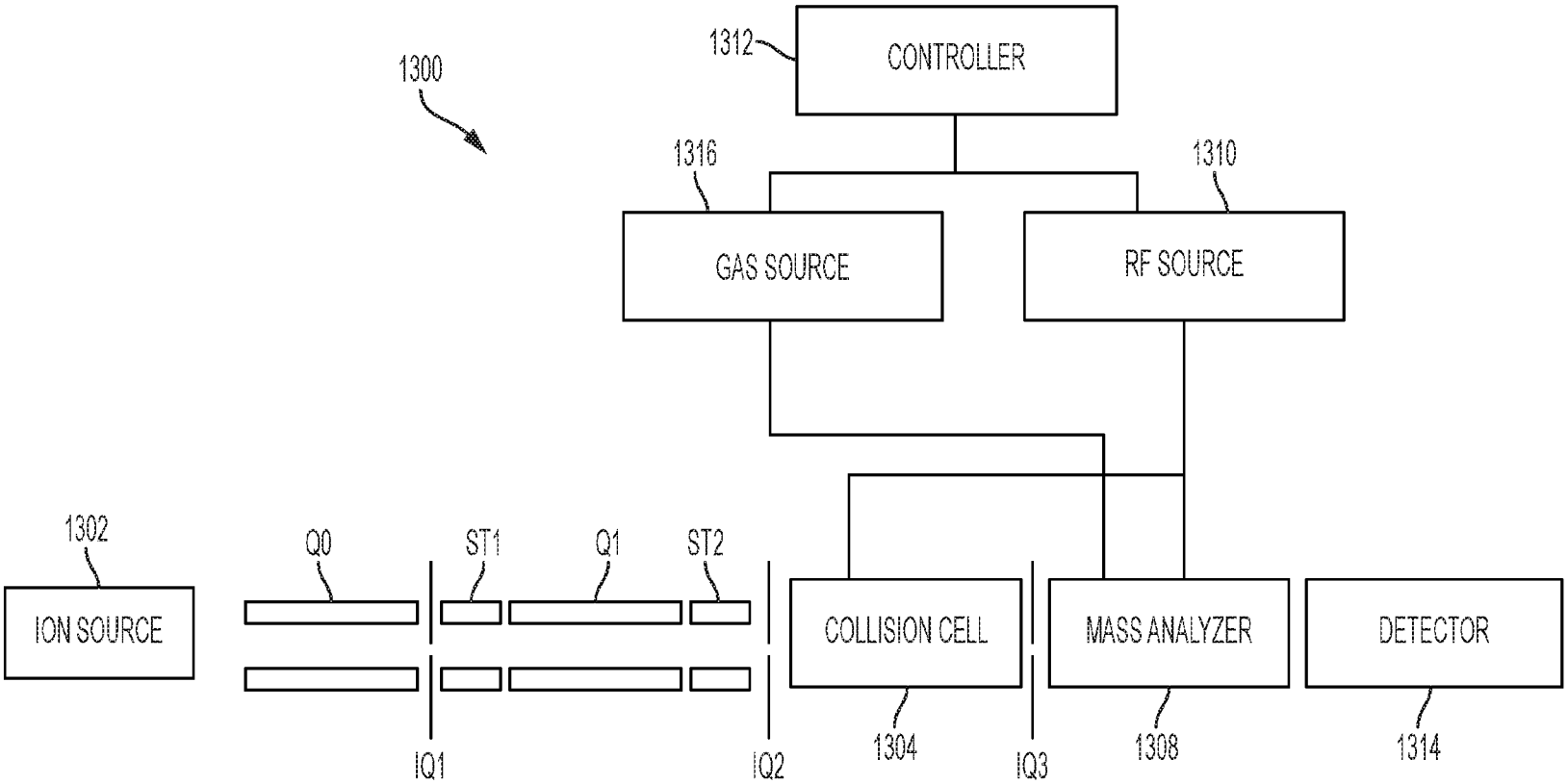

With reference to FIG. 4A, a mass spectrometer 1300 according to an embodiment includes an ion source 1302 for generating ions. The ion source can be separated from the downstream section of the spectrometer by a curtain chamber (not shown) in which an orifice plate (not shown) is disposed, which provides an orifice through which the ions generated by the ion source can enter the downstream section. In this embodiment, an RF ion guide (Q0) can be used to capture and focus the ions using a combination of gas dynamics and radio frequency fields. The ion guide Q0 delivers the ions via a lens IQ1 and Brubacker lens, e.g., an approximately 2.35 long RF only quadrupole, to a downstream quadrupole mass analyzer Q1, which can be situated in a vacuum chamber that can be evacuated to a pressure that can be maintained lower than that of the chamber in which RF ion guide Q0 is disposed. By way of non-limiting example, the vacuum chamber containing Q1 can be maintained at a pressure less than about $1\times10^{-4}$ Torr (e.g., about $5\times10^{-5}$ Torr), though other pressures can be used for this or for other purposes.

As will be appreciated by a person of skill in the art, the quadrupole rod set Q1 can be operated as a conventional transmission RF/DC quadrupole mass filter that can be operated to select an ion type of interest and/or a range of ion types of interest. By way of example, the quadrupole rod set Q1 can be provided with RF/DC voltages suitable for operation in a mass-resolving mode. As should be appreciated, taking the physical and electrical properties of Q1 into account, parameters for an applied RF and DC voltage can be selected so that Q1 establishes a transmission window of chosen m/z ratios, such that these ions can traverse Q1 largely unperturbed. Ions having m/z ratios falling outside the window, however, do not attain stable trajectories within the quadrupole and can be prevented from traversing the quadrupole rod set Q1. It should be appreciated that this mode of operation is but one possible mode of operation for Q1. By way of example, in some embodiments, the quadrupole rod set Q1 can be operated in RF only mode, thus acting as an ion guide for ions received from $Q_0$.

Ions passing through the quadrupole rod set Q1 can pass through the stubby ST2, also a Brubacker lens, to enter a collision cell 1304 in which at least a portion of the ions undergo fragmentation to generate ion fragments. In this embodiment, the collision cell includes a quadrupole rod set, though other multi-pole rod sets can also be employed in other embodiments. An RF voltage source 1310 operating under the control of a controller 1312 applies RF voltages to the rods of the collision cell to radially confine ions within the collision cell. Further, in this embodiment, IQ2 and IQ3 lenses are disposed in proximity of the inlet and outlet ports of the collision cell. By applying a DC voltage to the IQ3 lens that is higher than the collision cell's rod offset, axial trapping of the ions can be achieved.

Initially, the controller effects the RF voltage source to apply RF voltages to the rods of the collision cell that are suitable for radially confining ions having m/z ratios greater than a threshold, i.e., high m/z ions. By way of example, the RF voltages are selected to radially confine ions having m/z ratios greater than about 300, e.g., in a range of about 300 to about 1000.

With continued reference to FIG. 4A, an analyzer ion trap 1308 is positioned downstream of the collision cell 1304. In this embodiment, the analyzer ion trap 1308 includes a quadrupole rod set to which RF voltages are applied via the RF voltage source 1310 so as to provide radial confinement of ions therein. Initially, the RF voltages applied to the analyzer ion trap 1308 are selected so as to confine ions having m/z ratios above said threshold. In some embodiments, one or more electrodes positioned in the proximity of the input and/or output ports of the analyzer ion trap (not shown) can be employed to generate axial fields within the analyzer ion trap, e.g., via application of DC voltages to the electrodes, for axial confinement of the ions. In some embodiments, the downstream analyzer ion trap is capacitively coupled to the collision cell. Thus, setting the RF voltage at the analyzer ion trap can also provide the required RF voltage(s) at the collision cell. For example, the RF voltage(s) applied to the analyzer ion trap can be selected so as to obtain a q parameter greater than 0.3 for precursor ions when EPI scans are performed and for the largest m/z of interest when EMS scans are performed.

In this embodiment, the fragment ions contained in the collision cell are then released by setting the IQ3 voltage attractive for ions relative to the collision rod offset, and are introduced into the analyzer ion trap. As noted above, the RF voltages applied to the collision cell are selected to confine ions having high m/z ratios. As such, the ion fragments as well as in some cases precursor ions released from the collision cell and introduced into the downstream analyzer ion trap 1308 are primarily high m/z ions. The analyzer ion trap will provide effective confinement of these ions as the RF voltages applied to the analyzer ion trap are selected to provide radial confinement of such high m/z ions.

As shown in FIG. 4A, the spectrometer system 1300 further includes a gas source 1316 that operates under the control of the controller 1312 and is fluidly coupled to the mass analyzer ion trap 1308. Subsequent to or concurrent with the release of ions from the collision cell into the analyzer ion trap, the controller can activate the gas source 1316 to provide a gas pressure pulse to the analyzer ion trap so as to facilitate cooling of the ions contained therein. In some embodiments, the application of a gas pressure pulse to the analyzer ion trap can increase its internal pressure by at least about 100%, e.g., in a range of about 100% to about 400%, e.g., about 300%.

Figure 4B:
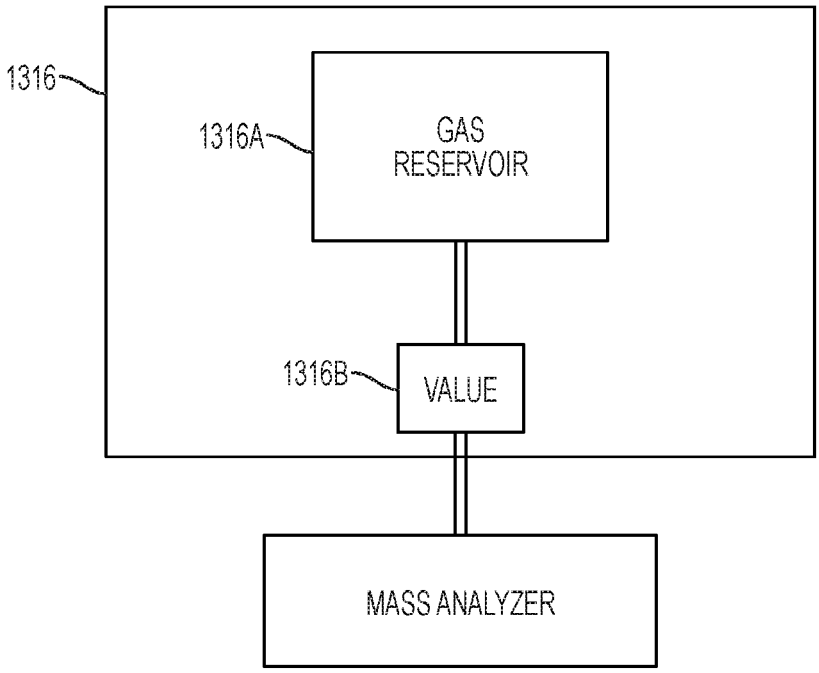

As shown schematically in FIG. 4B, the gas source 1316 can include, for example, a gas reservoir 1316*a* that is fluidly coupled via an actuable valve 1316*b* to the analyzer ion trap 1308. The valve 1316*b* can be actuated under the control of the controller 1312 so as to apply a pulse of gas to the analyzer ion trap.

Subsequently, the controller 1312 communicates with the RF source 1310 to cause the RF source to reduce the RF voltages applied to the collision cell 1304 and the downstream analyzer ion trap 1308. As noted above, the reduced RF voltages are selected so as to allow radial confinement of ions having m/z ratios below a threshold, i.e., the low m/z ions. By way of example, in some embodiments, the RF voltages, e.g., $V_{peak\text{-}to\text{-}peak}$ amplitude, can be reduced by a factor of about 10, e.g., by factor in a range of about 10 to about 20. The frequency of the RF voltages can remain unchanged. In some such embodiments, the low m/z ions can have, for example, m/z ratios less than about 300, e.g., in a range of about 50 to about 300.

Concurrent with or following the reduction of applied RF voltages to the collision cell and the downstream analyzer, a plurality of ions can be introduced into the collision cell, where they can undergo fragmentation with the low m/z fragment ions having a higher probability of being radially confined in the collision cell. The fragment ions (and in some cases a number of precursor ions) can then be released from the collision cell by reducing the DC voltage applied to IQ3 to a value below the collision cell rod offset, and be received by the downstream analyzer ion trap. Optionally, another gas pressure pulse can be applied to the analyzer ion trap to cause cooling of the ions therein. In this manner, the analyzer ion trap can be loaded with both high and low m/z ions. The ions can be Mass Selective Axially Ejected (MSAE) from the Q3 ion trap in a manner described by Hager in "*A new Linear ion trap mass spectrometer*," Rapid Commun. Mass Spectro. 2002; 16: 512-526.

In other embodiments, following the reduction of applied RF voltages to the collision cell and the downstream analyzer, a plurality of ions can be introduced into the collision cell, where they can undergo fragmentation with the low m/z fragment ions having a higher probability of being radially confined in the collision cell and be transmitted toward the analyzer without being axially trapped in the collision cell. Subsequently, the ions contained in the analyzer ion trap can be released therefrom, e.g., via MSAE. The released ions can then be detected by a downstream detector 1314 and a mass spectrum thereof can be generated.

In some embodiments, the collision cell 1304 can be configured so as to cause primarily cooling of the ions and not their fragmentation. For example, the kinetic energy of the ions entering the collision cell can be selected so that the ions will undergo collisional cooling without fragmentation. Similar to the previous embodiment, initially, the collision cell and the downstream analyzer are configured to radially confine low m/z ions. A plurality of precursor ions can enter the collision cell and then be released into the downstream analyzer ion trap where a gas pressure pulse can be applied via the gas source 1316 to the downstream analyzer ion trap 1308 to cause cooling of the ions. Subsequently, the collision cell and the downstream analyzer can be configured to confine low m/z ions. A plurality of ions can be introduced into the collision cell and then released into the analyzer ion trap. In this manner, the analyzer ion trap can be loaded with both high m/z and low m/z ions. The ions can then be released, e.g., via MSAE, from the analyzer ion trap to be detected by the detector 1314.

In some embodiments, the spectrometer system 1300 can lack a collision cell. In such an embodiment, the ions generated by the ion source 1302 are received by the mass analyzer 1308 after passage through the ion guide Q0 and the filter Q1. In such an embodiment, the mass analyzer 1308 can be initially configured to radially confine high m/z ions. Similar to the previous embodiments, a gas pressure pulse can be applied to the mass analyzer to cool the ions received thereby. This can be followed by reducing the RF voltages applied to the mass analyzer to configure it for radially confining low m/z ions. The mass analyzer can receive ions and trap low m/z ions. Optionally, another gas pressure pulse can be applied to the mass analyzer to cool the ions received thereby. Again, in this manner, the mass analyzer can be loaded with both high m/z and low m/z ions. After loading the mass analyzer with both high m/z and low m/z ions, the ions can be released from the mass analyzer, e.g., via MSAE, to be detected by a downstream detector 1314.

The present teachings provide a number of advantages. For example, they allow for efficient trapping of both high m/z and low m/z ions. In other words, they allow for efficient trapping of ions having a wide range of m/z ratios. This can in turn enhance the duty cycle of mass analysis. For example, the implementation of the present teachings can result in at least a factor of 2 improvement in the duty cycle of mass analysis.

The following example is provided for further elucidation of various aspects of the present teachings, and is not necessarily indicative of the optimal ways of practicing the present teachings and/or optimal results that may be achieved.

Example

Figure 5:
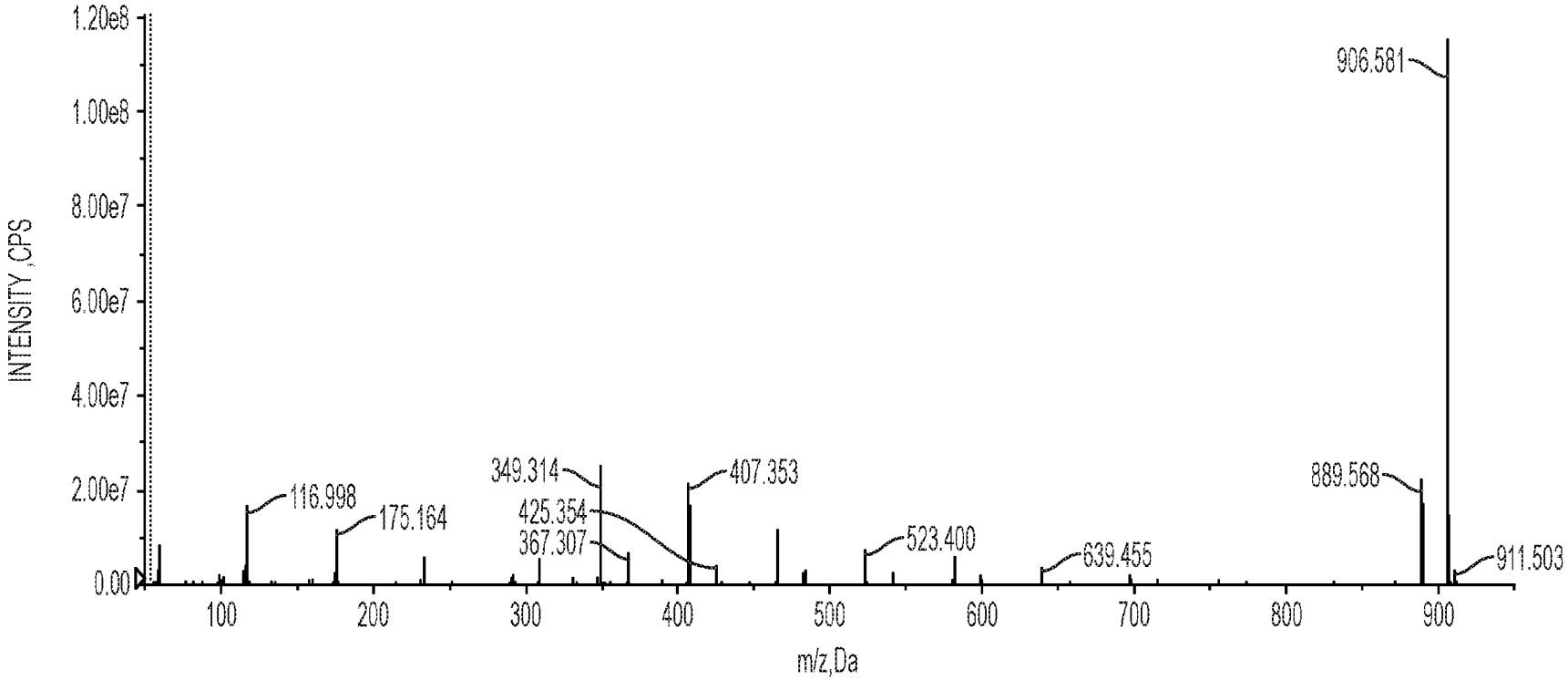
FIG. 5 depicts an EPI spectrum of PPG ions of m/z 906.6 obtained using the present teachings.

FIG. 5 depicts an EPI spectrum of PPG (poly(propylene glycol) ions of m/z 906.6 obtained using the present teachings. Specifically, a QTRAP 5500 mass spectrometer marketed by Sciex of Framingham, USA having a collision cell and a downstream linear ion trap was employed to obtain the depicted spectrum. The analyzer trap was set at q 0.28 for ions of m/z 906.7 and the Q2 collision cell was capacitively coupled to Q3 such as the q corresponding to the Q2 RF voltage was approximatively 0.17 for ions of m/z 906.7. The ions were selected in Q1 at unit resolution such as only the ions of m/z 906.7 would be transmitted and then fragmented in Q2 at a collision energy of 45 eV. After a fill time of 2 ms, the fragments and the remaining precursor ions were released and cooled in Q3 for about 5 ms. During this time, a pulsed valve increased the analyzer pressure to about $4\times10^{-5}$ Torr. After this time, the RF voltage applied to the Q3 was dropped to 0.046 $V_{peak\text{-}to\text{-}peak}$. At this RF voltage, the q for ions of m/z 50 was approximatively 0.846 in Q3 and approximately 0.5 in Q2. Subsequently, ions of m/z 906.7 were selected in Q1 at unit resolution then fragmented in Q2 at a collision energy of 45 eV. After a fill time of 2 ms, the fragments and the remaining precursor ions were released and cooled in Q3 for about 10 ms. During this time, a pulsed valve increased the analyzer pressure to about $6\times10^{-5}$ Torr. Subsequently, a mass spectrum was generated by scanning the ions from the Q3 analyzer trap using MSAE at a scan rate of 10000 Da/s.

Figure 6:
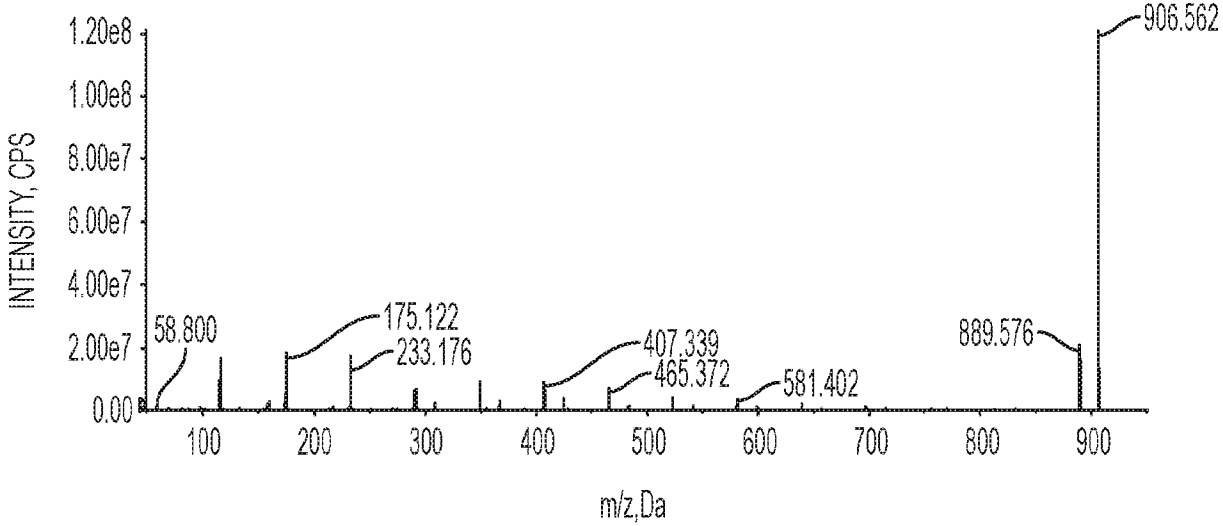
FIG. 6 depicts an EPI spectrum of PPG ions of m/z 906.6, where the spectrum was obtained by parsing the mass scan in three different ranges.

FIG. 6 in turn depicts an EPI spectrum of PPG ions of m/z of 906.6 obtained using conventional methods. In this case, the mass scan was parsed in three different mass ranges: 50-103, 103-309 and 309-920.

The above data shows that the methods according to the present teachings can be used to obtain similar mass spectra compared to those obtained using conventional methods, but with a reduced duty cycle.

Those having ordinary skill in the art will appreciate that various changes can be made to the above embodiments without departing from the scope of the invention.

What is claimed is:

1. A method of processing ions in a mass spectrometer, comprising:

introducing a first plurality of precursor ions into a collision cell so as to cause fragmentation of at least a portion of said first plurality of the precursor ions into a plurality of ion fragments, said collision cell comprising a plurality of rods to at least one of which an RF voltage can be applied for radially confining at least a portion of said ion fragments, selecting said RF voltage applied to said collision cell so as to preferentially radially confine ions having m/z ratios above a threshold ("high m/z ions"), selecting at least one RF voltage applied to at least one rod of a downstream analyzer ion trap so as to preferentially radially confine said high m/z ions, releasing the ions including the high m/z ions from said collision cell into said downstream analyzer ion trap, applying a pressure pulse to said analyzer ion trap so as to expedite cooling of the ions received by the analyzer ion trap from the collision cell, subsequently, reducing said RF voltages applied to said collision cell and said downstream analyzer ion trap to a level suitable for radially confining ions having m/z ratios below said threshold ("low m/z ions"), introducing a second plurality of precursor ions into said collision cell to generate a plurality of ion fragments, introducing the ions including low m/z ions from the collision cell into said analyzer ion trap such that the analyzer ion trap contains both the high m/z and the low m/z ions, and releasing the ions from said analyzer ion trap using mass selective axial ejection.

2. The method of claim 1, wherein said pressure pulse is applied to said downstream analyzer ion trap concurrently with the introduction of said ion fragments ions into said analyzer ion trap.

3. The method of claim 1, wherein the application of said pressure pulse to said analyzer ion trap is delayed relative to the introduction of the ions into said analyzer ion trap.

4. The method of claim 1, wherein the application of said pressure pulse to said analyzer ion trap is commenced prior to introduction of the ions into the analyzer ion trap.

5. The method of claim 1, wherein the ions released from the analyzer ion trap comprise the ion fragments and at least a portion of remaining precursor ions contained in the analyzer ion trap.

6. The method of claim 1, further comprising:

using an ion source for generating ions, and using a filter to select said precursor ions having a desired m/z ratio from said generated ions for introduction into said collision cell.

7. The method of claim 6, wherein said filter comprises an RF/DC filter.

8. The method of claim 1, further applying an axial field to said collision cell for providing axial confinement of the ions in the collision cell.

9. The method of claim 1, wherein said RF voltages applied to the collision cell and the downstream analyzer ion trap for radially confining said high m/z ion fragments are selected to generate a Mathieu parameter (q) greater than about 0.16;

optionally, wherein said RF voltages applied to the collision cell and said downstream analyzer ion trap for radially confining said low m/z ion fragments are selected to generate a Mathieu parameter (q) lower than about 0.906 and greater than about 0.05.

10. The method of claim 1, wherein said gas pressure pulse increases an internal pressure of said analyzer ion trap by at least about 100% for at least about 2 milliseconds.

11. The method of claim 1, wherein said ion fragments have m/z ratios equal to or greater than about 50;

optionally, wherein said ion fragments have m/z ratios equal to or less than about 1000.

12. A mass spectrometer, comprising:

a collision cell, a downstream analyzer ion trap, wherein the collision cell is configured to:

receive first precursor ions and cause at least a portion of the first precursor ions into first ion fragments, release the first ion fragments into the collision cell, after releasing the first ion fragments, receive second precursor ions and cause fragmentation of at least a portion of the second precursor ions into second ion fragments, and release the second ion fragments into the collision cell, an RF voltage source configured to:

apply a first voltage to the collision cell and a second voltage to the analyzer ion trap, wherein the first and second voltages preferentially confine high m/z ions, apply a third voltage to the collision cell and a fourth voltage to the analyzer ion trap after the first fragment ions have been released into the analyzer ion trap, wherein the third voltage and the fourth voltages preferentially confine low m/z ions, wherein the third and fourth voltages are lower than the first and second voltages respectively, and wherein the collision cell is configured to simultaneously contain high m/z ions and low m/z ions.

13. The mass spectrometer of claim 12, further comprising a controller that is configured to cause mass selective axial ejection of the ions from said analyzer ion trap.

14. The mass spectrometer of claim 12, further comprising an ion source for generating ions.

15. The mass spectrometer of claim 14, further comprising a mass filter for receiving said ions and selecting said plurality of precursor ions for introduction into said collision cell;

optionally, wherein said mass filter comprises an RF/DC mass filter.

16. The mass spectrometer of claim 12, wherein said collision cell comprises a plurality of rods arranged in a quadrupole configuration.

17. The mass spectrometer of claim 12, wherein said analyzer ion trap comprises a plurality of rods arranged in a quadrupole configuration.

18. The mass spectrometer of claim 12, wherein said first or second ion fragments have m/z ratios greater than about 50;

optionally, wherein said fragment ions have m/z ratios less than about 1000;

optionally, wherein said fragment ions have m/z ratios less than about 3000.

19. The mass spectrometer of claim 12, wherein said at least one RF voltage source is capactively coupled to said collision cell and said downstream analyzer ion trap.

20. A method of processing ions in a mass spectrometer having a first ion trap and an analyzer ion trap positioned downstream of said first ion trap, each of said ion traps having a plurality of rods to at least one of which an RF voltage can be applied for radially confining at least a portion of ions within said trap, the method comprising:

applying an RF voltage to said first ion trap so as to preferentially radially confine ions having m/z ratios above a threshold ("high m/z ions"), applying an RF voltage to said downstream analyzer ion trap so as to preferentially radially confine said high m/z ions, introducing a plurality of ions into said first ion trap, releasing at least a portion of said trapped ions from said first ion trap and introducing said released ions into said downstream analyzer ion trap, applying a pressure pulse to said downstream analyzer ion trap so as to expedite cooling of the ions received by said downstream analyzer ion trap, subsequently, reducing the RF voltages applied to said first ion trap and said downstream analyzer ion trap to a level suitable for radially confining ions having m/z ratios below said threshold ("low m/z ions"), introducing a plurality of ions into said first ion trap, releasing at least a portion of said ions from said first ion trap and introducing said released ions into said downstream analyzer ion trap such that the analyzer ion trap contains both the high m/z ions and the low m/z ions, and releasing the ions from said downstream analyzer ion trap using mass selective axial ejection.

* * * * *